United States Patent [19]

Avery

[11] Patent Number: 4,785,947

[45] Date of Patent: Nov. 22, 1988

[54] MARKER CADDY

[76] Inventor: Frederick M. Avery, 3502 E. Cochise Rd., Phoenix, Ariz. 85028

[21] Appl. No.: 7,924

[22] Filed: Jan. 28, 1987

Related U.S. Application Data

[63] Continuation-in-part of Ser. No. 899,129, Aug. 22, 1986.

[51] Int. Cl.[4] ..... A47F 7/00

[52] U.S. Cl. ..... 211/695; 211/128

[58] Field of Search ..... 211/69.5, 126, 128, 211/133, 189, 74, 60.1, 69.1, 71, 88

[56] References Cited

U.S. PATENT DOCUMENTS

| | | | |
|---|---|---|---|
| 2,198,459 | 4/1940 | Potts | 206/72 |
| 2,916,013 | 12/1959 | Rhoades et al. | 211/69.5 X |
| 3,176,662 | 4/1965 | Williams | 211/69.5 |
| 3,300,055 | 1/1967 | Rohr | 211/74 |
| 3,866,992 | 2/1975 | Katz | 211/69.5 |
| 4,374,565 | 2/1983 | Neumann | 211/69.5 |
| 4,538,736 | 9/1985 | Berger | 211/69.5 |
| 4,548,325 | 10/1985 | Hojer et al. | 211/69.5 |

*Primary Examiner*—Ramon S. Britts
*Assistant Examiner*—Sarah A. Lechok Eley
*Attorney, Agent, or Firm*—John E. Benoit

[57] ABSTRACT

A marker holder is supported within the frame and comprises a plurality of rows of marker trays extending across the width of the holder and extending in a stair-step configuration from the bottom to the top of the holder. Each tray includes a plurality of wells at the front of the tray and a plurality of first arcuate indentations at the rear of the tray mating with said wells. Substantially all of trays include a plurality of second arcuate indentations at the rear of the tray which extend above the base of the wells of the adjacent upper tray and align with the wells of the adjacent upper tray. The distance between the extremities between said first and second arcuate indentations being greater than the diameter of said well so as to provide a shelf adjacent the top of said well. There is also disclosed support means for maintaining at least one marker holder or a row of marker holders at an inclined angle when placed on a flat surface. Additionally, there is disclosed a holder which is removably mounted to the frame for providing additional support means such as a hook or the like.

8 Claims, 6 Drawing Sheets

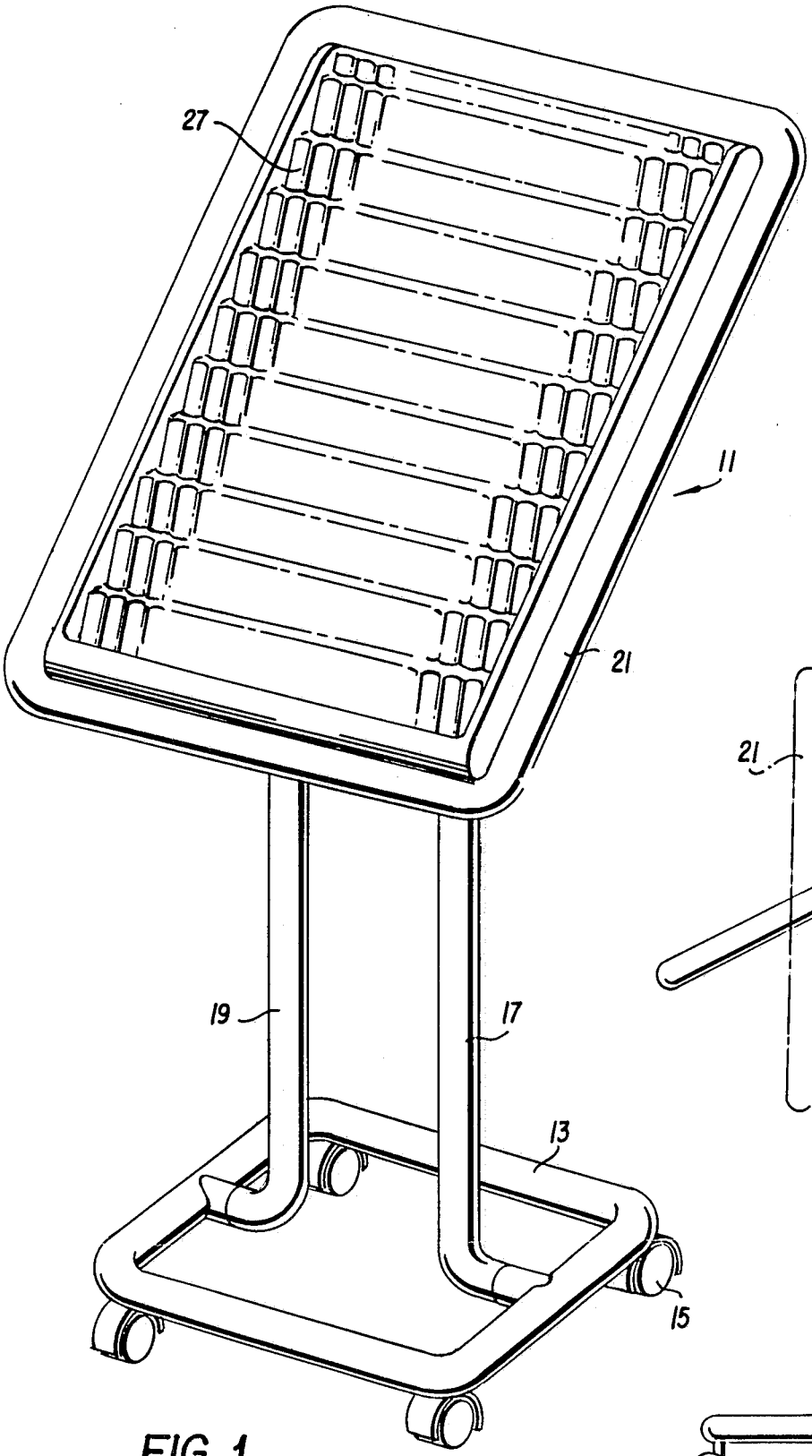
FIG. 1
FIG. 3
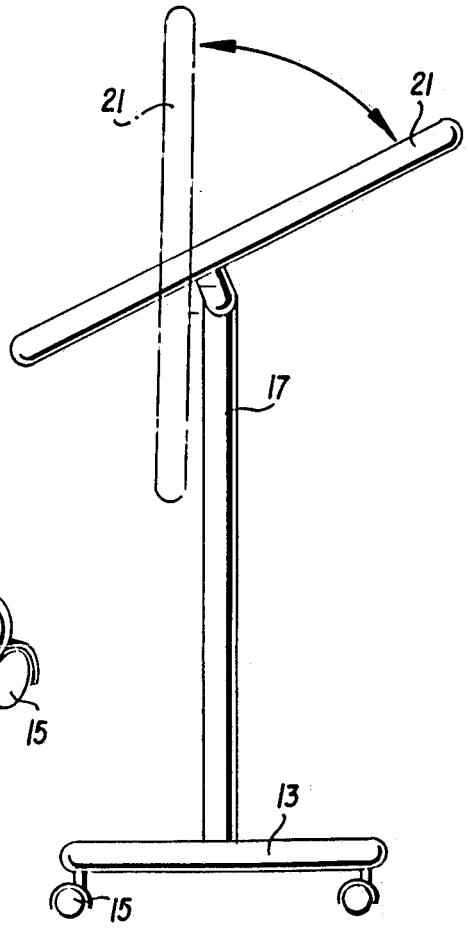

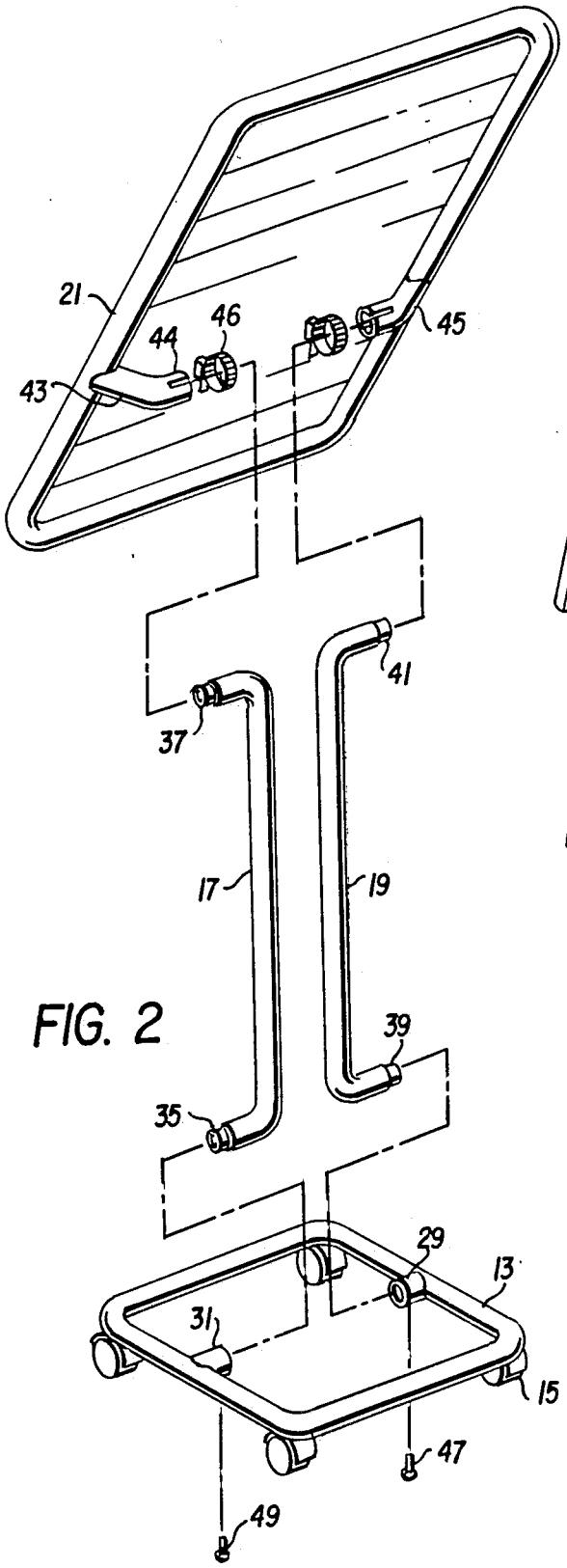
FIG. 2
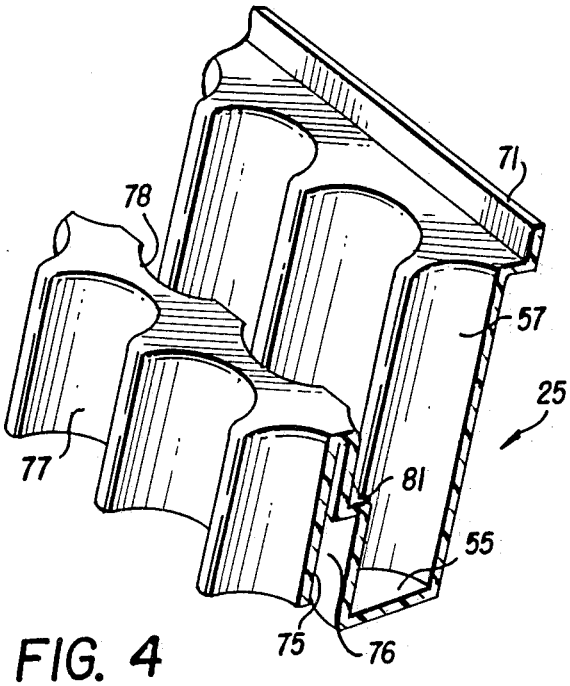
FIG. 4
FIG. 5
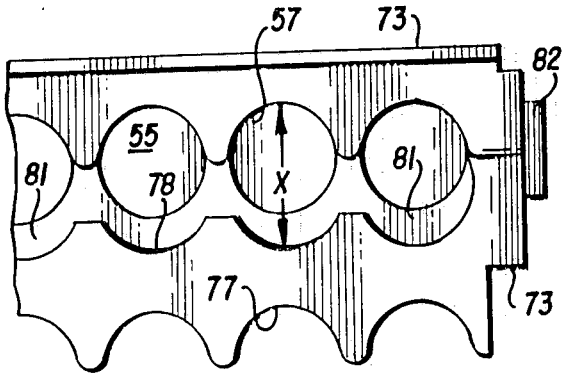

MARKER CADDY

This application is a continuation-in-part of U.S. application Ser. No. 899,129 filed Aug. 22, 1986, in the name of the present inventor.

This invention relates generally to marker caddies and more specifically to a tray/caddy designed to hold a multiplicity of various types of markers in a convenient and accessible manner.

The use of well known colored markers is extensive for various types of illustrative and other drawing purposes. The person using these markers requires various numbers of markers due to the need of a wide range of colors, values, hues and different functional uses of markers.

Conventional marker trays made by the marker manufacturers are designed to hold only their own specific markers depend on desk, credensa, taboret or drawing table placement, hold a limited number of markers per tray, and, are designed to accommodate only one specific physical shape and size of marker pen.

Markers, and the trays that contain them, are not used at all times during a normal work day by most creative people, and, in some cases, are used only a portion of their working profile. Thus, when they are not being used, the trays available at the present time take up valuable work surface space needed for other art processes and, in short, become a nuisance.

Accordingly, it is an object of the present invention to provide a marker caddy which can be positioned and repositioned if needed next to the designer/creative person in a comfortable position without taking up work surface areas.

It is a further object of the present invention to provide a marker tray which can be placed at any angle and positioned so as to provide easy marker access and best visual selection.

It is a further object of this invention to provide a marker tray which is easily moved to different floor locations when desired and can easily be located to be shared by another creative person.

It is a further object of this invention to provide a marker caddy which provides an orderly, and neat arrangement for storing and color categorizing the markers in one full view.

A still further object of the present invention is to provide a marker caddy having trays which will accommodate substantially all of the generally available marker pens regardless of their bottom configuration, cap design or barrel size.

Yet another object of the invention is to provide a base and support for a marker holder or a row of marker holders when placed on a flat surface.

A still further object of the invention is to provide a holder which removably attaches to the frame and which provides a means for carrying or holding various pieces of equipment related to the use of the marker caddy.

These and other objects of the present invention will be apparent from the following description when taken together with the drawings.

SUMMARY OF THE INVENTION

The present invention provides a marker caddy for holding and displaying a plurality of markers having different cap designs, bottom configurations, barrel diameters and heights and includes a base which may be mounted on wheels. Upright support members are attached to the base together with a frame pivotally mounted at the upper end of the support members. A marker holder is supported within the frame and comprises a plurality of rows of marker trays extending across the width of the holder and also extending in a stair-step configuration from the bottom to the top of the holder. Each tray includes a plurality of wells in the lower portion of the tray and a plurality of arcuate indentations in the front of the upwardly extending rear portion of the tray mating with the wells. Substantially all of trays include a further plurality of arcuate indentations in the back of the upwardly extending rear portion of the tray, with the upper portion extending above the top of the wells of the next adjacent upper tray and in alignment with and spaced from said wells. This provides a shelf between the top of said wells and the arcuate indentations at the back of the upwardly extending rear portion of the next lower tray whereby markers having barrel sizes larger than said wells can rest upon the shelf and be retained by the indentations. In one embodiment of the invention each row of trays is molded separately and configured so as to mate with the next upper and next lower row of trays so as to form the plurality of rows of marker trays in the desired stairstep configuration. The pivotal mounting frame provides "tilt back" of the tray assembly which permits larger markers to be supported against the indentations even if they do not rest in the wells. In another embodiment, a single tray mates with a support so that it may be placed on a flat surface. A further embodiment includes a holder which may be removably mounted to the basic frame.

BRIEF DESCRIPTION OF THE DRAWINGS

FIG. 1 is a perspective view of the base and support stand for the marker trays;

FIG. 2 is a perspective exploded view of the rear of the base, support and tray holder showing a preferred construction thereof;

FIG. 3 is a side view of the structure of FIG. 1 illustrating the available angular adjustment of the tray holder;

FIG. 4 is a partial sectional view of one tray level;

FIG. 5 is a partial top view of the tray level of FIG. 4; and

DETAILED DESCRIPTION OF THE PREFERRED EMBODIMENT

Figure 6:
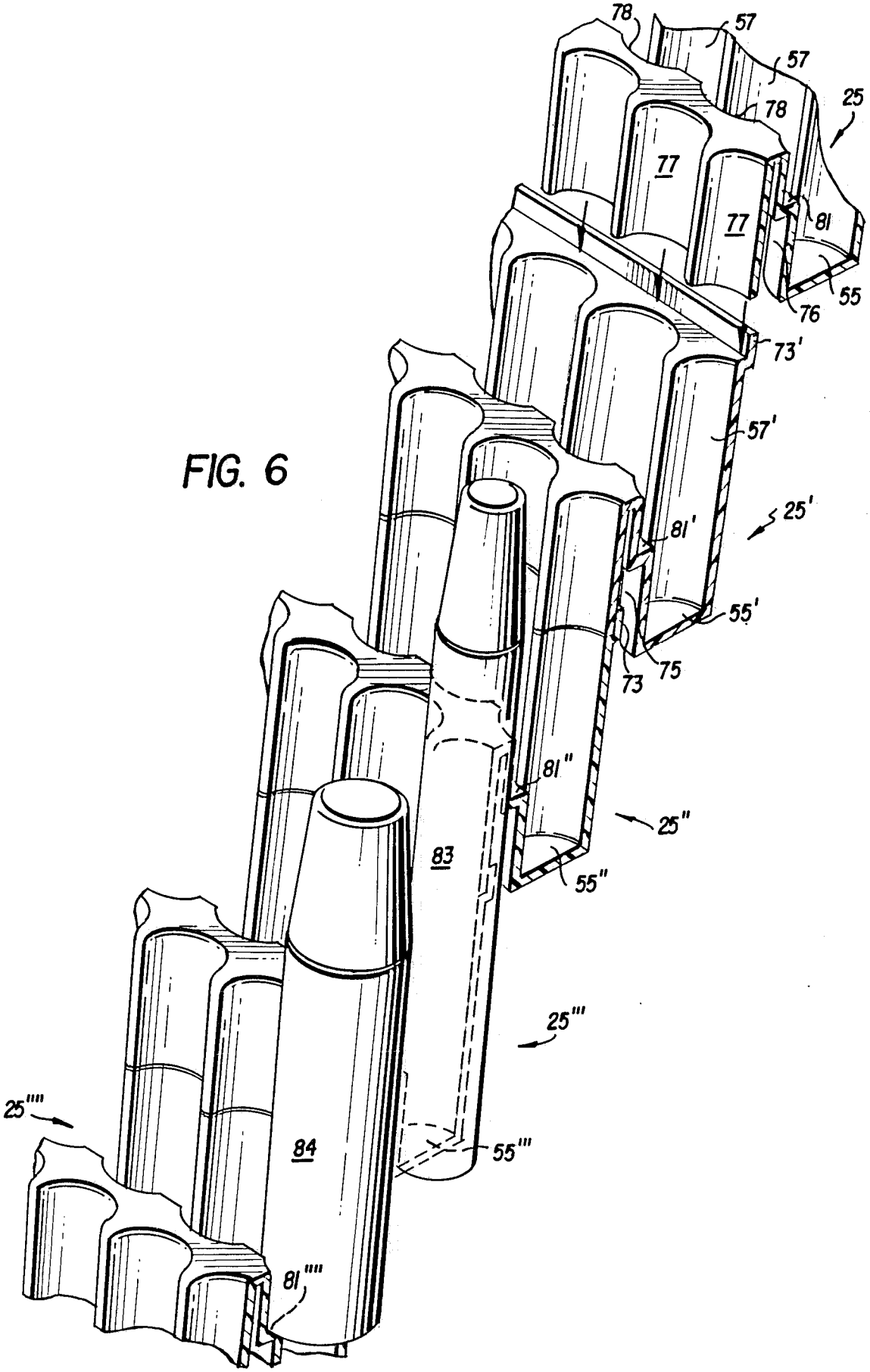
FIG. 6 is a partial sectional view showing the relationship between adjacent stair-stepped trays which creates the additional half round indentation height to assist in holding the barrel of the marker.

Turning now more specifically to the drawings, there is shown in FIG. 1 one embodiment of a marker caddy 11 of the present invention. This caddy includes base 13 mounted on casters 15 with two support legs 17 and 19 extending upwardly from base 13.

Frame 21 is mounted to legs 17 and 19 and carries therein a plurality of marker trays having configurations as generally indicated by trays 25 and 27.

Referring to FIG. 2, one type of construction is shown for the embodiment of the caddy disclosed in FIG. 1. It is understood that this construction is not to be considered limiting of the present invention. As can be seen, base 13 includes two integral hollow cylindrical protrusions 29 and 31. Legs 17 and 19 are generally C-shaped and terminate in reduced sections 35, 37 and 39, 41.

Sections 35 and 39 mate with and pass into hollow cylindrical protrusions 31 and 29 and are secured therein by means such as set screws 47, 49.

Protrusions 37 and 41 at the upper end of legs 17 and 19 mate with hollow elbows 43 and 45 which are integral with frame 21 and extend rearwardly therefrom. Each of the elbows have pressure relief slots 44 and 44'. Once elbows 43 and 45 pass over protrusions 37 and 41, compression clamps 46 fit about the ends of the elbows. Tightening of the compression clamps secures the elbows about protrusions 37 and 41. This permits infinite adjustment of the angular position of frame 21 with respect to support legs 17 and 19 as illustrated in FIG. 3.

Referring now to FIG. 4, each tray contains a basic section 25 which includes a plurality of adjacent wells 55 which extend into the base of the tray. A plurality of arcuate indentations 57 mate with and extend above each well. In the embodiment shown, these indentations are formed by a structure which is integral with the well structure. An upstanding rail 71 is integral with and extends rearwardly of arcuate indentations 57. Wall 75 is integral with the tray structure and extends along the length thereof so as to form channel 76. A further set of arcuate indentations 78 are formed in the side of wall 75 facing wells 55. A still further plurality of arcuate indentations 77 are formed opposite indentations 78 and have substantially the same radius of curvature as arcuate indentations 57. Channel 76 is provided so as to allow rail 71 to rest within channel 76 of the next higher tray for stair-stepping attachment as will be further described hereinbelow.

FIG. 5 is a partial top view of the tray of FIG. 4 which more clearly discloses the arcuate indentations 78 opposed to indentations 77 both of which are in alignment with the adjacent well. Arcuate indentations 78 are located such that the distance x between the extremities of indentations 57 and 78 is greater than the diameter of well 55. Since indentations 78 are not adjacent the well, this creates shelf area 81 extending from the upper edge of the well. The purpose of such a shelf will be apparent from the discussion which follows. Additionally, each tray includes keys 82 at either end which fit into end cap mating slots (not shown) to create the tray assembly which is then mounted into tubular frame caddy.

Turning now to FIG. 6, the unique stair-step configuration of the present invention is shown. Five trays, 25 through 25'''', such as previously described, are shown in attached and unattached positions. Since all trays are attached in the same manner, only one such attachment will be described. In order to attach the trays, rail 73' of tray 25' is fitted into channel 76 of tray 25 as indicated by the arrows. This effectively mates indentations 77 with indentations 57' creating an additional height of indentations 57' and provides further cradle support for markers which rest in well 55' or on shelf 81'.

FIG. 6 further illustrates the versatility of the tray in adapting to markers having different bottom configuration, cap design or barrel size. Marker 84 is shown as having a barrel size larger than well 55'''. Such a marker rests on shelf area 81''' and is supported by opposite arcuate indentations. Marker 83 has a barrel size which fits within well 55'''' and is supported by the well and the adjacent arcuate indentations. It should be noted that the uppermost tray as illustrated in FIG. 1 terminates with arcuate indentation 57 which results in a one-half stair-step. This is still adequate for markers which fit within the well.

The construction of the marker trays as described above provides an economical process for molding the components and assembling same. However, it should be understood that the entire stair-step tray structure could be produced as one piece from a single mold.

It may be desirable to use a single marker holder or a row of marker holders of the type shown in FIGS. 4 and 5 as a single entity rather than in the holder of FIG. 1. This may occur when a person has selected markers which will be used for a single job and wishes to have them separately at hand on his desk or a table nearby. In such case, there is a need for a support means for maintaining the marker holder or row of holders in an inclined position so that the pens may be cradled properly, as previously discussed in connection with the caddy of FIG. 1.

Figure 7:
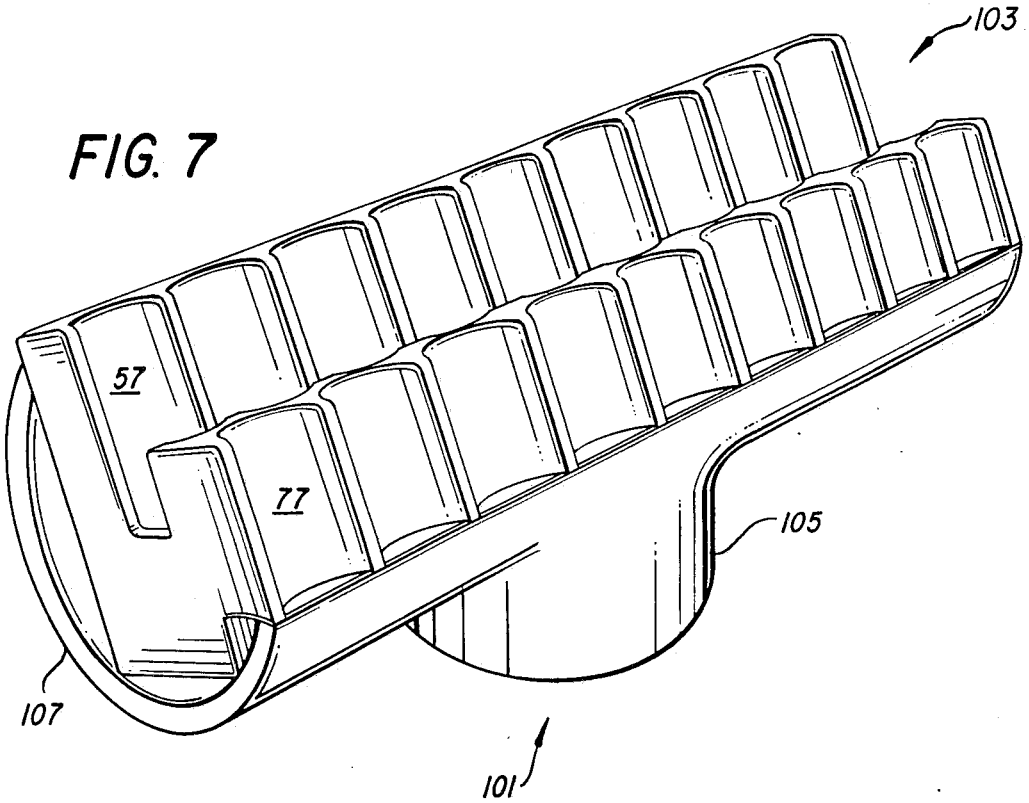
FIG. 7 is a perspective view of a row of marker holders and a support therefor.
Figure 8:
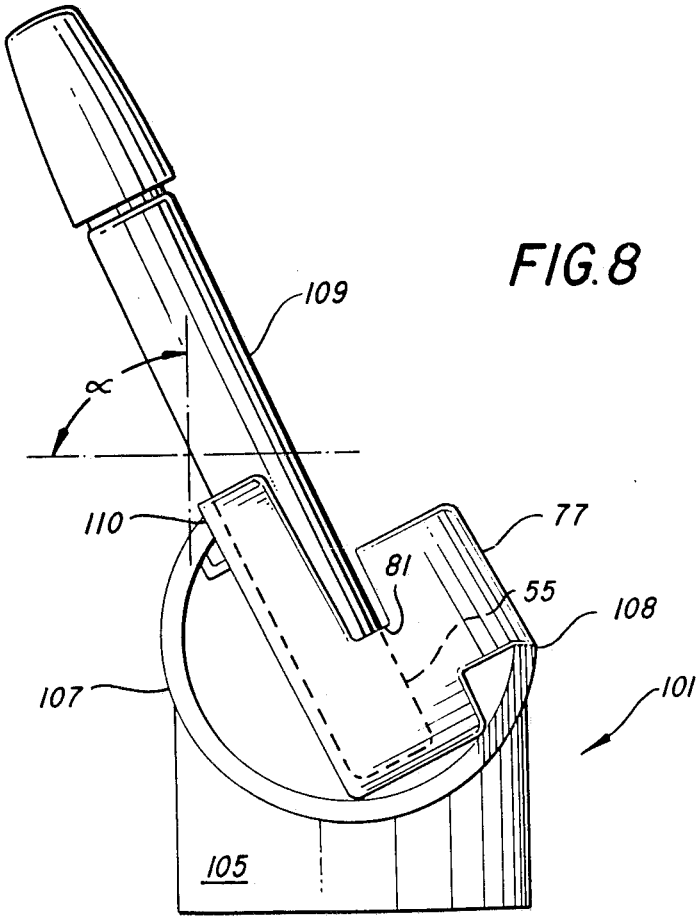
FIG. 8 is an end view of the markers and holder of FIG. 7.

FIGS. 7 and 8 disclose one such support member. A molded base 101 includes a pedestal 105 and an arcuate cradle means 107. Preferably, the base and tray are a single-molded unit and are designed, in this case, for supporting the particular row of holders as previously discussed. In viewing the marker as shown from the end in FIG. 108, it can be seen that the lower part of section 77 rests on one end 108 of cradle means 107 while the back of the holder rests against the other end 110 of the arcuate cradle. This provides the angle o which permits the pens to angle back and rest in their respective cradle areas 57. Depending on the size of pen 109, it will either drop into the well 55 or it will still be cradled and rest upon shelf 81, as previously described.

It is to be understood that the specific configuration of the holder may be varied while still providing the proper angular support without departing from the present invention.

Figure 9:
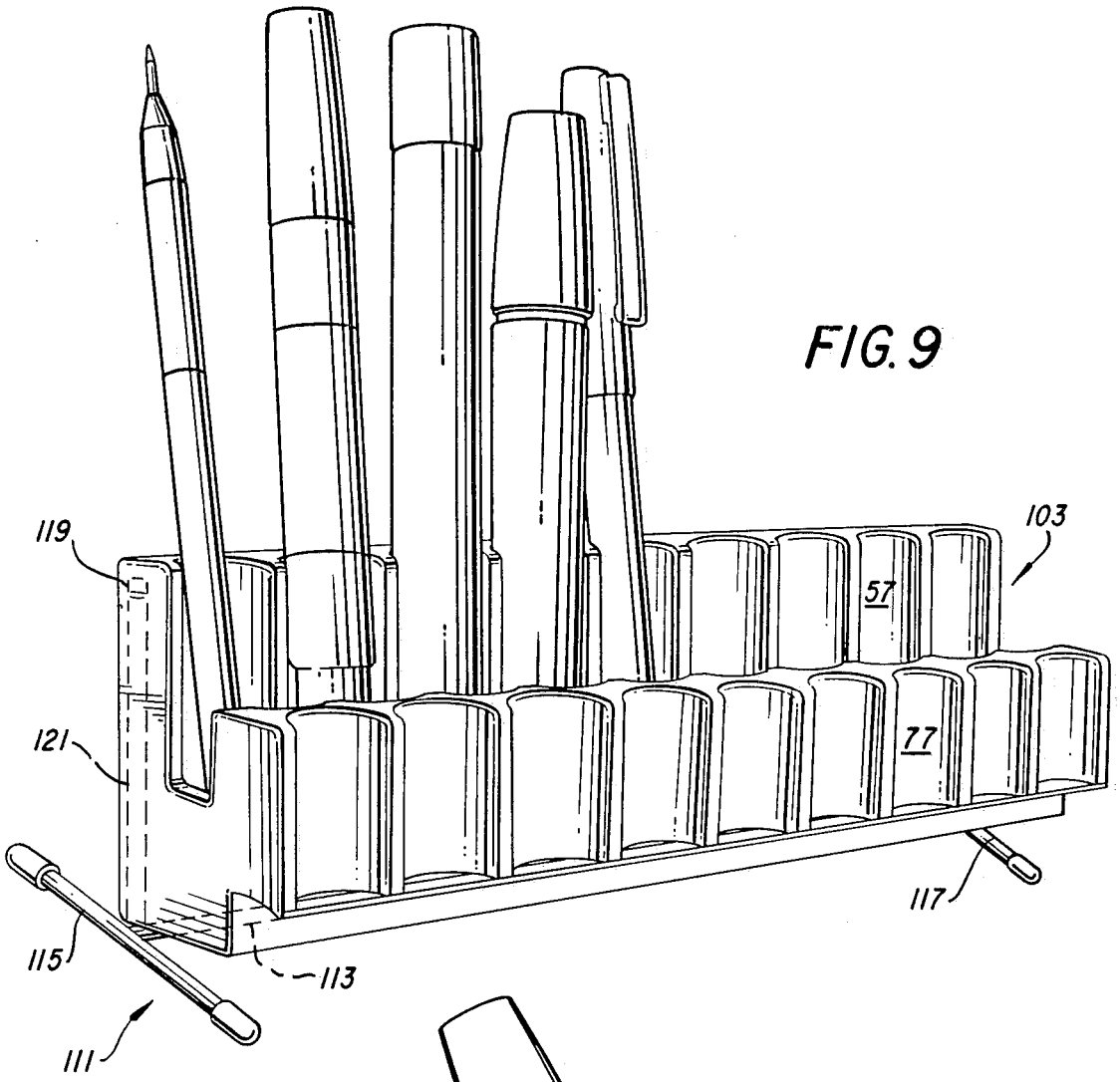
FIG. 9 is a perspective of a modification of the support of FIG. 7.
Figure 10:
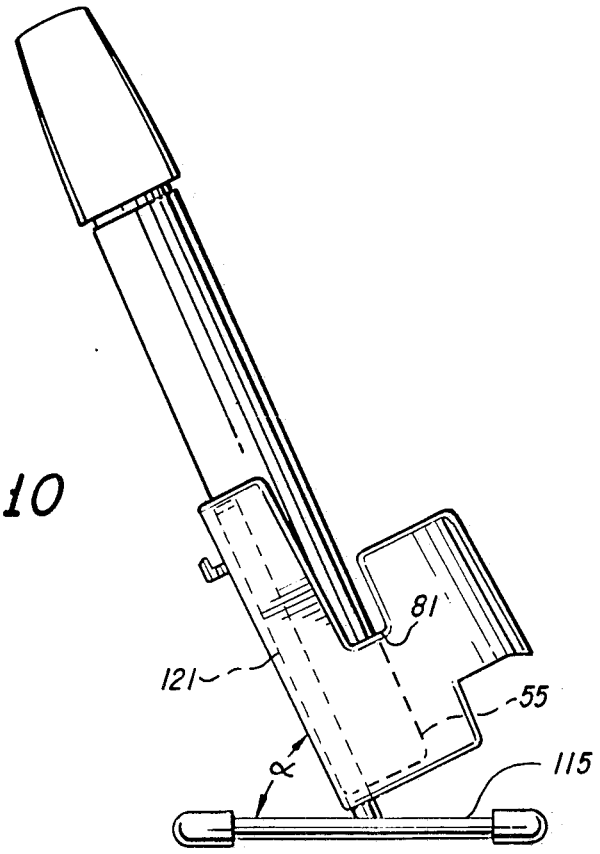
FIG. 10 is an end view of the markers and holder of FIG. 9.

A further type of support means is disclosed in FIGS. 9 and 10. This comprises a wire form base 11 having legs 115 and 117 interconnected by extending longitudinal section 113. Arm 121 and a similar arm at the other end (not shown) extend upwardly from section 113. In order to accommodate arms 121, the marker tray, itself, is provided with boreholes 119, preferably at either end, of a diameter and a length to accommodate arms 121. Again, the arms 121 extend at an angle o from section 113 so as to provide the proper resting position for the pens in the cradle areas 57.

As will be obvious, this type of arrangement shown in FIGS. 7 and 8 or FIGS. 9 and 10 could be used with a single pen holder or with any number of pen holders. It is advantageous, however, to adapt the base holders so that the marker trays may be interchangeable for use with the caddy of FIG. 1, as well as individually.

It should be noted that for use such as shown in FIGS. 7–10, indentations 77 act merely as a visual design element and are mechanically not functional. Accordingly, if desired, area arcuate portion 77 could be eliminated with an insert in the injection molded tool whereby the insert would create a smooth, non-patterned lower front area where arcuate sections 77 exist.

Figure 11:
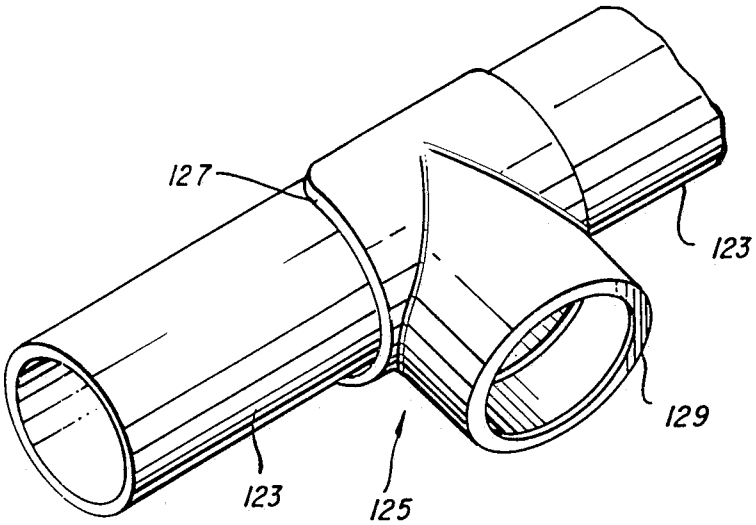
FIG. 11 is a perspective view of a compression coupler for use with the frame of FIG. 1.
Figure 12:
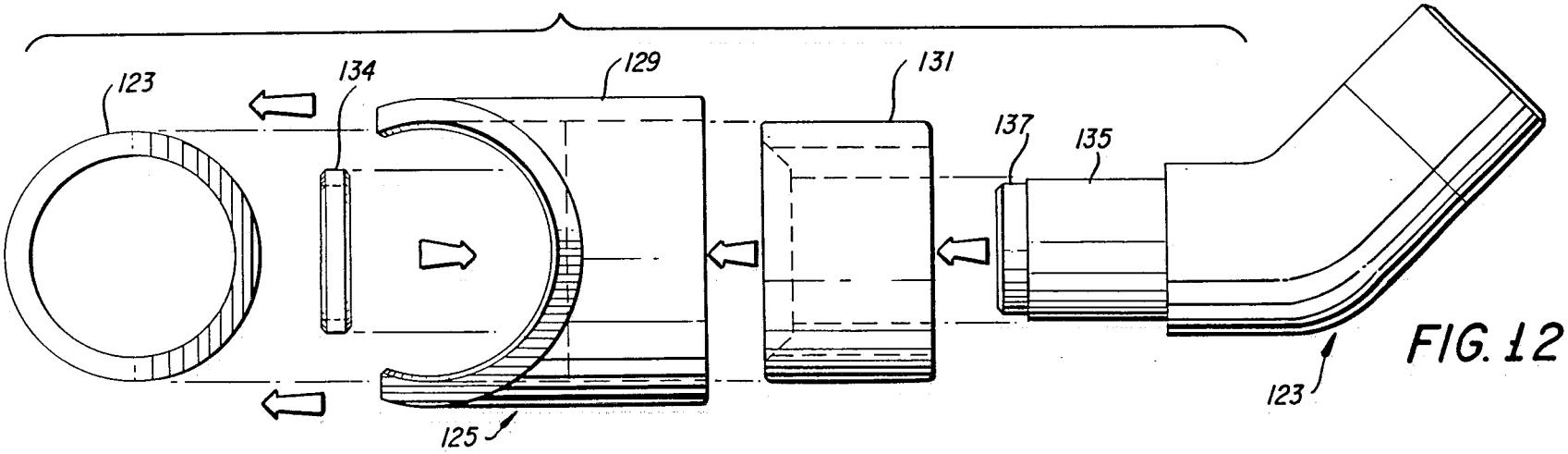
FIG. 12 is an exploded view of a modification of the compression coupler of FIG. 11.

It may also be desirable to provide some type of support means for tools which are used in the trade by the person who would normally be using the marker caddy of the present invention. Such a connector is illustrated in FIGS. 11 and 12. In this figure there is shown a tubular member 123 which may be part of the frame of the marker caddy of FIG. 1. Snap-on compression coupler 125 is shown removably clamped on the tubular frame member 123. This compression clamp consists of semirigid arcuate plate 127 which has an interior circumference greater than 180 degrees and is geometrically configured so as to mate with frame member 123 when in place, as shown in FIG. 11. Molded with plate 127 and extending from the outer face thereof is a tubular section 129 which is hollow so that it may frictionally retain various accessories which may be used.

FIG. 12 shows a modification of FIG. 11 which still uses the basic snap-on compression coupler 125 which mates with tubular frame member 123, as discussed above. In this exploded view, there is also disclosed a reduction adapter 131 which has an outer diameter for frictionally engaging tubular section 129. The purpose of such an adapter is to permit use of accessories which may have a smaller diameter coupling leg than the opening provided in tubular section 129. One such accessory is shown as utility hook 123, which has reduced section 135 and terminal end 137. When the parts are assembled, snap lock ring 139 secures against terminal end 137 and maintains utility hook in place within compression coupler 125. One advantage in this type of construction, either with or without the reduction adapter, is that it allows rotation of the accessory, such as the utility hook, within the coupler so that it can be placed at an angle convenient to the hanging of various articles while still being frictionally retained by the coupler.

Some of the many items which can be designed to be used with compression coupler 125 would include a container for holding scissors or knives or the like, a device which would hold or contain pens that must be stored horizontally, means for attaching an additional palette bar which might hold a select choice of colors to be used for specific rendering in much the same manner as with the single row as supported in FIGS. 7–10. Obviously, the number of attachments which may be used with the compression coupler are numerous and may be designed for any specific purpose.

As will now be evident, the present invention provides an "unselfish" marker caddy. This tray, when used in the stair-step fashion as described above, creates a back support cradle to hold the barrel portion of most marker pens. The shelf created on each level spaced from the wells is designed to accommodate pens having a barrels larger in diameter than the wells. This combination of recessed wells, front and rear arcuate supports and stair-stepping, together with the adjustable tray angle or "tilt back", creates a structure which holds and cradles substantially all of the known sizes of commercial markers in use today.

Additionally, the fact that the marker tray may be adjusted to various positions by pivoting, as described above, allows the user to position the markers at the best angle for viewing and selection.

The ability to move the marker between work areas, and even into positions where it may be jointly shared, removes the marker from the work surface so as to provide greater work surface as well as greater flexibility in the use of the markers.

The "unselfish" feature is maintained when a single marker holder or a row of marker holders is supported on a flat surface, such as a desk top.

The above description and drawings are illustrative only since modifications in structure and relative locations could be varied without departing from the invention, the scope of which is to be limited only by the following claims.

I claim:

1. A marker caddy comprising
a rigid body;
a well extending into said body;
a first arcuate indentation in said body adjacent to and extending above the top of said well;
a second arcuate indentation integral with said body substantially aligned with, displaced from and extending above the top of said well opposite said first arcuate indentation, the distance between the opposed extremity of said first indentation and said second indentation being greater than the diameter of the top of said well so as to provide a shelf adjacent to the top of said well; and
support means for holding said body at a preselected inclined angle relative to said support means.

2. The marker caddy of claim 1 further comprising
a plurality of said marker holders and associated arcuate surfaces above the top of said wells extending in adjacent alignment and held by said support means.

3. The marker caddy of claim 1 wherein said support means comprises
a base; and
a recessed holder integral with and extending above said base.

4. The marker caddy of claim 3 wherein said recessed holder is arcuate.

5. The marker caddy of claim 1 wherein said support means comprises
at least two boreholes extending from the underside and into said body; and
a substantially rigid frame including two legs interconnected by a cross member and arms extending upwardly from said cross member at a predetermined angle;
said arms being of a dimension and spaced so as to mate with said boreholes so as to support said body at said predetermined angle.

6. A marker caddy comprising
a base;
a tubular closed frame mounted on said base;
a plurality of marker holders mounted within said frame;
a compression coupler removably mountable on said frame, said coupler comprising
a semirigid arcuate plate having an inner face circumference greater than 180 degrees;
a hollow tubular section integral with and extending from the outer face of said arcuate plate; and
an adapter of a dimension so as to frictionally mate within said tubular section;
said adapter having means for retaining support members.

7. The marker caddy of claim 6 wherein said support member is removably engageable with said tubular section.

8. The marker caddy of claim 7 further comprising means for securing said support member to said body.

* * * * *